US007764236B2

(12) United States Patent
Hill et al.

(10) Patent No.: US 7,764,236 B2
(45) Date of Patent: Jul. 27, 2010

(54) BROADBAND ANTENNA FOR HANDHELD DEVICES

(75) Inventors: Robert J. Hill, Salinas, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 283 days.

(21) Appl. No.: 11/650,072

(22) Filed: Jan. 4, 2007

(65) Prior Publication Data

US 2008/0165064 A1 Jul. 10, 2008

(51) Int. Cl.
*H01Q 1/24* (2006.01)
*H01Q 9/28* (2006.01)

(52) U.S. Cl. ..... 343/702; 343/795

(58) Field of Classification Search ..... 343/700 MS, 343/702, 872, 873, 795, 846, 767, 793; 455/575.1, 455/575.7, 575.8, 90.3
See application file for complete search history.

(56) References Cited

U.S. PATENT DOCUMENTS 4,590,614 A * 5/1986 Erat ..... 455/270
6,054,952 A 4/2000 Shen et al.
6,266,538 B1 7/2001 Waldron
6,906,675 B2 6/2005 Satoh et al.
6,963,310 B2 11/2005 Horita et al.
7,002,519 B2 2/2006 Wang et al.
7,023,388 B2 4/2006 Shimabara
7,042,400 B2 5/2006 Okubo et al.
7,362,275 B2 * 4/2008 Tu et al. ..... 343/702
7,432,870 B2 * 10/2008 Teshima et al. ..... 343/767
2003/0063036 A1 4/2003 Sato et al.
2005/0128161 A1 6/2005 Kagaya et al.
2006/0017643 A1 * 1/2006 Shimasaki et al. ..... 343/795
2006/0214856 A1 9/2006 Nakano et al.
2006/0238425 A1 * 10/2006 Oodachi ..... 343/702
2007/0241971 A1 * 10/2007 Tsujimura et al. ..... 343/702

FOREIGN PATENT DOCUMENTS

KR 1020030054845 A 7/2003

* cited by examiner

*Primary Examiner*—Hoang V Nguyen
*Assistant Examiner*—Robert Karacsony
(74) *Attorney, Agent, or Firm*—Treyz Law Group; G. Victor Treyz; David C. Kellogg

(57) ABSTRACT

Broadband antennas and handheld electronic devices with broadband antennas are provided. A handheld electronic device has integrated circuits, a display, and a battery mounted within a housing. The housing has a planar inner surface. A broadband antenna for the handheld electronic device has a ground element and a resonating element. The ground element and resonating element may have the same shape and may have the same size. The ground element and resonating element may lie in a common plane and be separated by a gap that lies in the common plane. The plane in which the ground element and resonating element lie may be parallel to the planar inner surface of the housing. Electronic components such as the integrated circuits, display, and battery can be mounted in the handheld device so that they do not overlap the gap between the ground element and the resonating element.

16 Claims, 15 Drawing Sheets

BROADBAND ANTENNA FOR HANDHELD DEVICES

BACKGROUND

This invention relates generally to antennas, and more particularly, to broadband antennas in wireless handheld electronic devices.

Handheld electronic devices are often provided with wireless capabilities. Handheld electronic devices with wireless capabilities use antennas to transmit and receive radio-frequency signals. For example, cellular telephones contain antennas that are used to handle radio-frequency communications with cellular base stations. Handheld computers often contain short-range antennas for handling wireless connections with wireless access points. Global positioning system (GPS) devices typically contain antennas that are designed to operate at GPS frequencies.

As technology advances, it is becoming possible to combine multiple functions into a single device and to expand the number of communications bands a single device can handle. For example, it is possible to incorporate a short-range wireless capability into a cellular telephone. It is also possible to design cellular telephones that cover multiple cellular telephone bands.

The desire to cover a wide range of radio frequencies presents challenges to antenna designers. It is typically difficult to design antennas that cover a wide range of communications bands while exhibiting superior radio-frequency performance. This is particularly true when designing antennas for handheld electronic devices where antenna size and shape can be particularly important.

As a result of these challenges, conventional handheld devices that need to cover a large number of communications bands tend to use multiple antennas, antennas that are undesirably large, antennas that have awkward shapes, or antennas that exhibit poor efficiency.

It would therefore be desirable to be able to provide an improved broadband antenna for a handheld electronic device.

SUMMARY

In accordance with the present invention, broadband antennas and handheld electronic devices with broadband antennas may be provided.

A broadband antenna may have a ground element and a resonating element that are separated by a gap. The ground element and the resonating element may lie in a common plane. With one suitable arrangement, the ground element and the resonating element may have the same shape and same size. Suitable antenna element shapes include squares and other rectangles, triangles, shapes with curved edges such as circles, etc.

A handheld electronic device may have a planar front face and a planar inner surface such as a lower inner surface associated with the rear portion of a plastic handheld electronic device housing. The ground element and resonating element may be mounted to the planar inner surface of the housing. For example, the ground element and the resonating element may be formed by attaching portions of adhesive-backed metal foil to the inner surface of the housing. The ground element and the resonating element may also be formed from portions of the housing itself (e.g., when the housing is made of metal).

A handheld electronic device in accordance with the present invention may contain electronic components such as integrated circuits, a display, and a battery mounted within a housing.

Components such as these may contain substantial conductive portions. For example, integrated circuits may be surrounded with conductive radio-frequency shielding. Liquid crystal displays (LCDs) and other displays may contain planar ground conductors. Batteries may have thin rectangular cases formed from aluminum or other metals.

To avoid interfering with the proper operation of the broadband antenna, the electronic components may be mounted within the housing of the handheld electronic device so that the edges of the components do not overlap the gap between the ground element and the resonating element. For example, the edges of the electronic components may lie within the edges of the ground element and within the edges of the resonating element. With one suitable arrangement, the integrated circuit is located above the ground element and the battery and display are located above the resonating element.

Further features of the invention, its nature and various advantages will be more apparent from the accompanying drawings and the following detailed description of the preferred embodiments.

DETAILED DESCRIPTION

Figure 1:
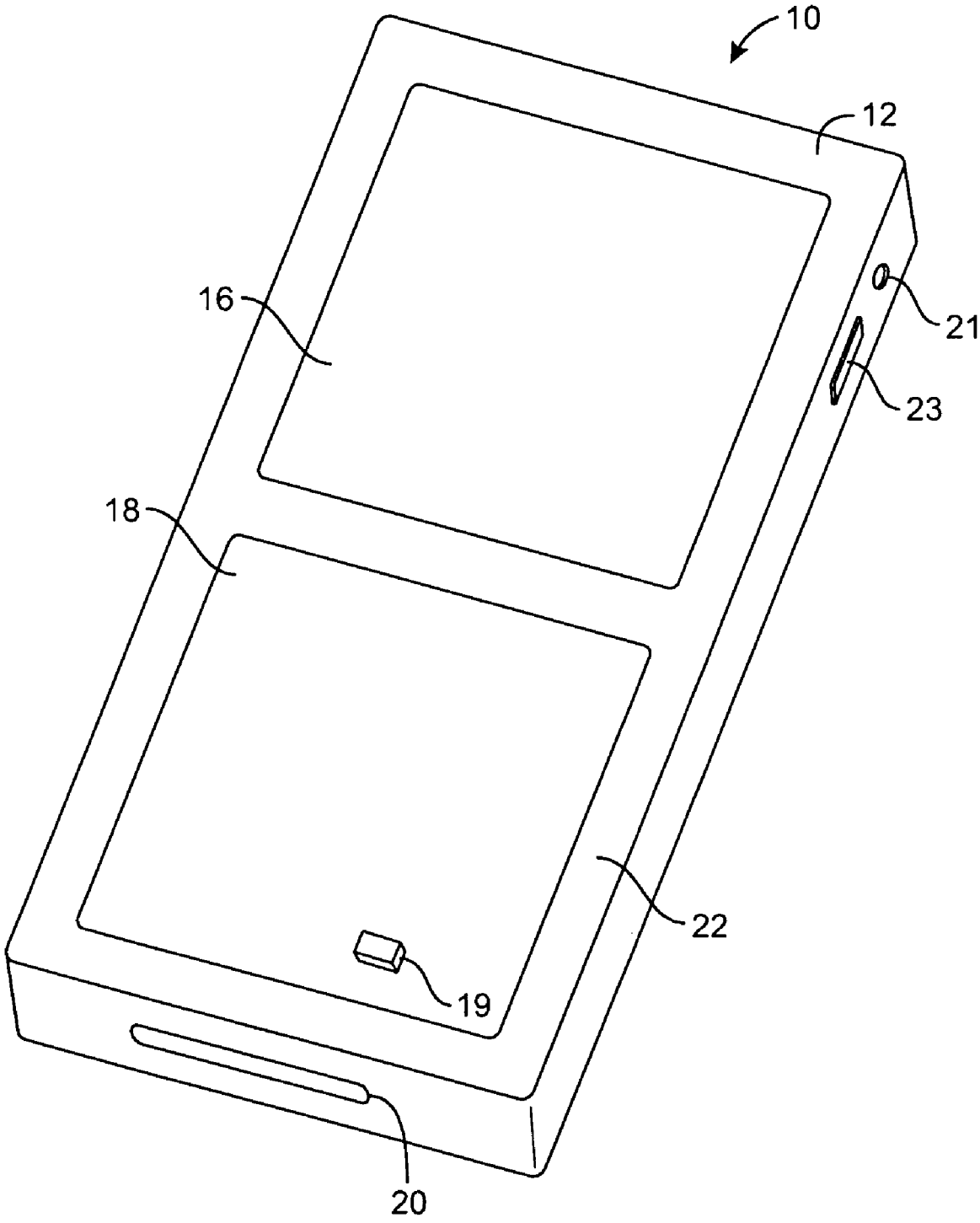
FIG. 1 is a perspective view of an illustrative handheld electronic device with a broadband antenna in accordance with the present invention.

An illustrative portable electronic device in accordance with the present invention is shown in FIG. 1. Portable electronic devices such as illustrative portable electronic device 10 may be small portable computers such as those sometimes referred to as ultraportables. Portable devices may also be somewhat smaller devices. Examples of smaller portable devices include wrist-watch devices, pendant devices, headphone and earpiece devices, and other wearable and miniature devices. With one particularly suitable arrangement, the portable electronic devices are handheld electronic devices. The use of handheld devices is generally described herein as an example, although any suitable electronic device may be used if desired.

Handheld devices may be, for example, cellular telephones, media players with wireless communications capabilities, handheld computers (also sometimes called personal digital assistants), remote controllers, global positioning system (GPS) devices, and handheld gaming devices. The handheld devices of the invention may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples. Device 10 may be any suitable portable or handheld electronic device.

Device 10 includes housing 12 and includes at least one antenna of a type that is sometime referred to as a broadband antenna. Housing 12, which is sometimes referred to as a case, may be formed of any suitable materials including, plastic, wood, glass, ceramics, metal, or other suitable materials, or a combination of these materials. In some situations, case 12 may be a dielectric or other low-conductivity material, so that the operation of conductive antenna elements that are located in proximity to case 12 is not disrupted. In other situations, case 12 may be formed from metal elements that serve as antenna elements for the broadband antenna.

The broadband antenna in device 10 may have a ground element (sometimes called a ground) and a resonant element (sometimes called a radiating element or antenna feed element). Antenna terminals, which are sometimes referred to as the antenna's ground and feed terminals are electrically connected to the antenna's ground and resonant element, respectively.

Handheld electronic device 10 may have input-output devices such as a display screen 16, buttons such as button 23, user input control devices 18 such as button 19, and input-output components such as port 20 and input-output jack 21. Display screen 16 may be, for example, a liquid crystal display (LCD), an organic light-emitting diode (OLED) display, a plasma display, or multiple displays that use one or more different display technologies. As shown in the example of FIG. 1, display screens such as display screen 16 can be mounted on front face 22 of handheld electronic device 10. If desired, displays such as display 16 can be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface 18. User input interface 18 may include buttons (e.g., alphanumeric keys, power on-off, power-on, power-off, and other specialized buttons, etc.), a touch pad, pointing stick, or other cursor control device, a touch screen (e.g., a touch screen implemented as part of screen 16), or any other suitable interface for controlling device 10. Although shown schematically as being formed on the top face 22 of handheld electronic device 10 in the example of FIG. 1, user input interface 18 may generally be formed on any suitable portion of handheld electronic device 10. For example, a button such as button 23 (which may be considered to be part of input interface 18) or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as bus connector 20 and jack 21 that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device 10 can be controlled using input interface 18.

Components such as display 16 and user input interface 18 may cover most of the available surface area on the front face 22 of device 10 (as shown in the example of FIG. 1) or may occupy only a small portion of the front face 22. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antenna of handheld electronic device 10 to function properly without being disrupted by the electronic components.

Figure 2:
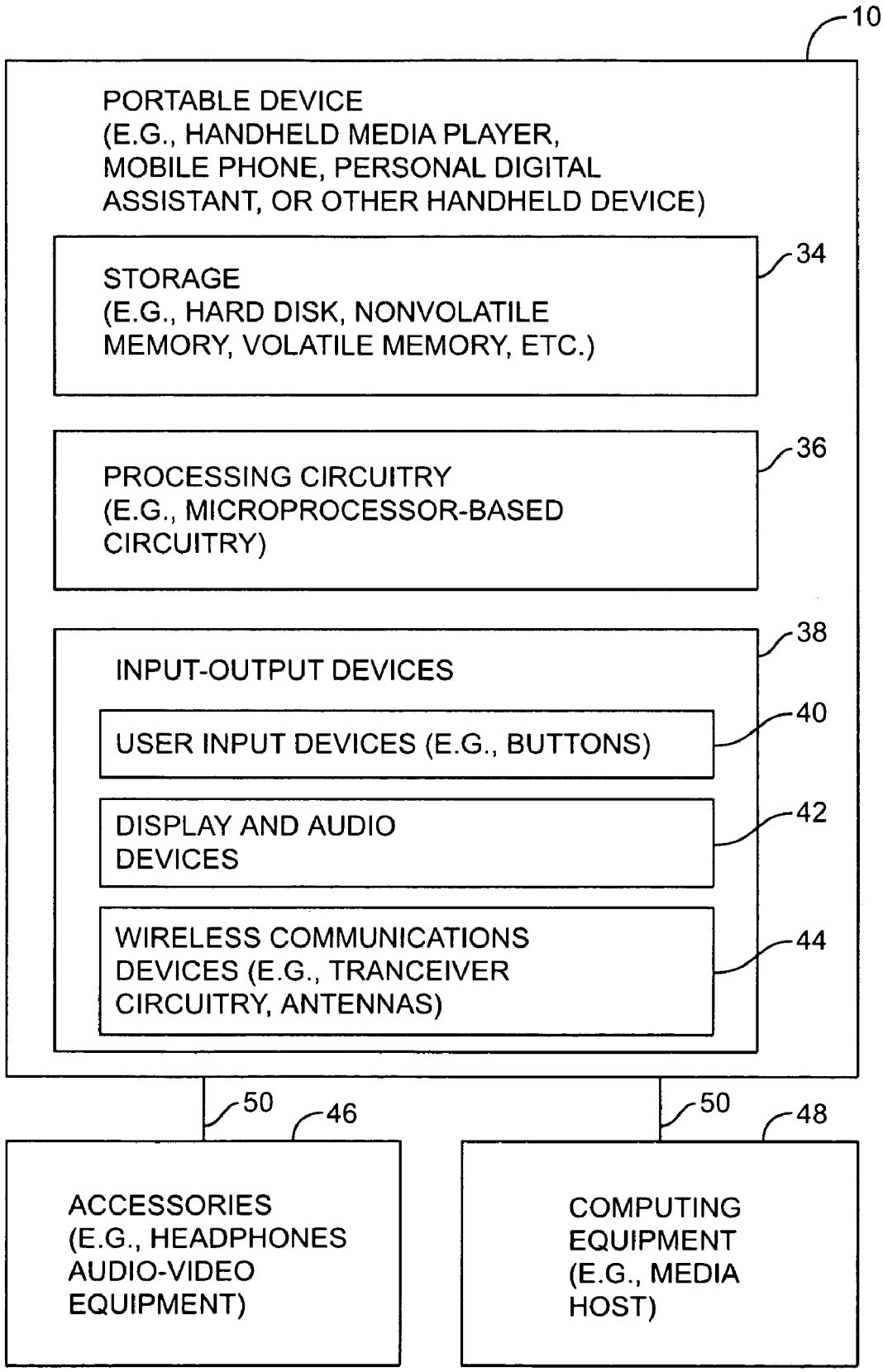
FIG. 2 is a schematic diagram of an illustrative handheld electronic device and illustrative equipment with which the handheld electronic device may interact wirelessly in accordance with the present invention.

A schematic diagram of an illustrative handheld electronic device of the type that may contain a broadband antenna is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits.

Input-output devices 38 may be used to allow data to be supplied to device 10 and to allow data to be provided from device 10 to external devices. Display screen 16 and user input interface 18 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, such as a broadband antenna of the type described in connection with FIG. 1, and, if desired, additional antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content). Computing equipment 48 may be a server from which songs, videos, or other media are downloaded over a cellular telephone link or other wireless link. Computing equipment 48 may also be a local host (e.g., a user's own personal computer), from which the user obtains a wireless download of music or other media files.

The wireless communications devices 44 may be used to cover communications frequency bands such as the cellular telephone bands at 850 MHz, 900 MHz, 1800 MHz, and 1900 MHz, the global positioning system (GPS) band at 1575 MHz, data service bands such as the 3G data communications band at 2170 MHz band (commonly referred to as UMTS or Universal Mobile Telecommunications System), the WiFi® (IEEE 802.11) band at 2.4 GHz, and the Bluetooth® band at 2.4 GHz. These are merely illustrative communications bands over which wireless devices 44 may operate. Additional bands are expected to be deployed in the future as new wireless services are made available. Wireless devices 44 may be configured to operate over any suitable band or bands to cover any existing or new services of interest. If desired, multiple antennas may be provided in wireless devices 44 to cover more bands or one or more antennas may be provided with wide-bandwidth resonating elements to cover multiple communications bands of interest. An advantage of using a broadband antenna design that covers multiple communications bands of interest is that this type of approach makes it possible to reduce device complexity and cost and to minimize the amount of a handheld device that is allocated towards antenna structures.

A broadband design may be used for one or more antennas in wireless devices 44 when it is desired to cover a relatively larger range of frequencies without providing numerous individual antennas or using a tunable antenna arrangement. If desired, a broadband antenna design may be made tunable to expand its bandwidth coverage or may be used in combination with additional antennas. In general, however, broadband designs tend to reduce or eliminate the need for multiple antennas and tunable configurations.

Figure 3:
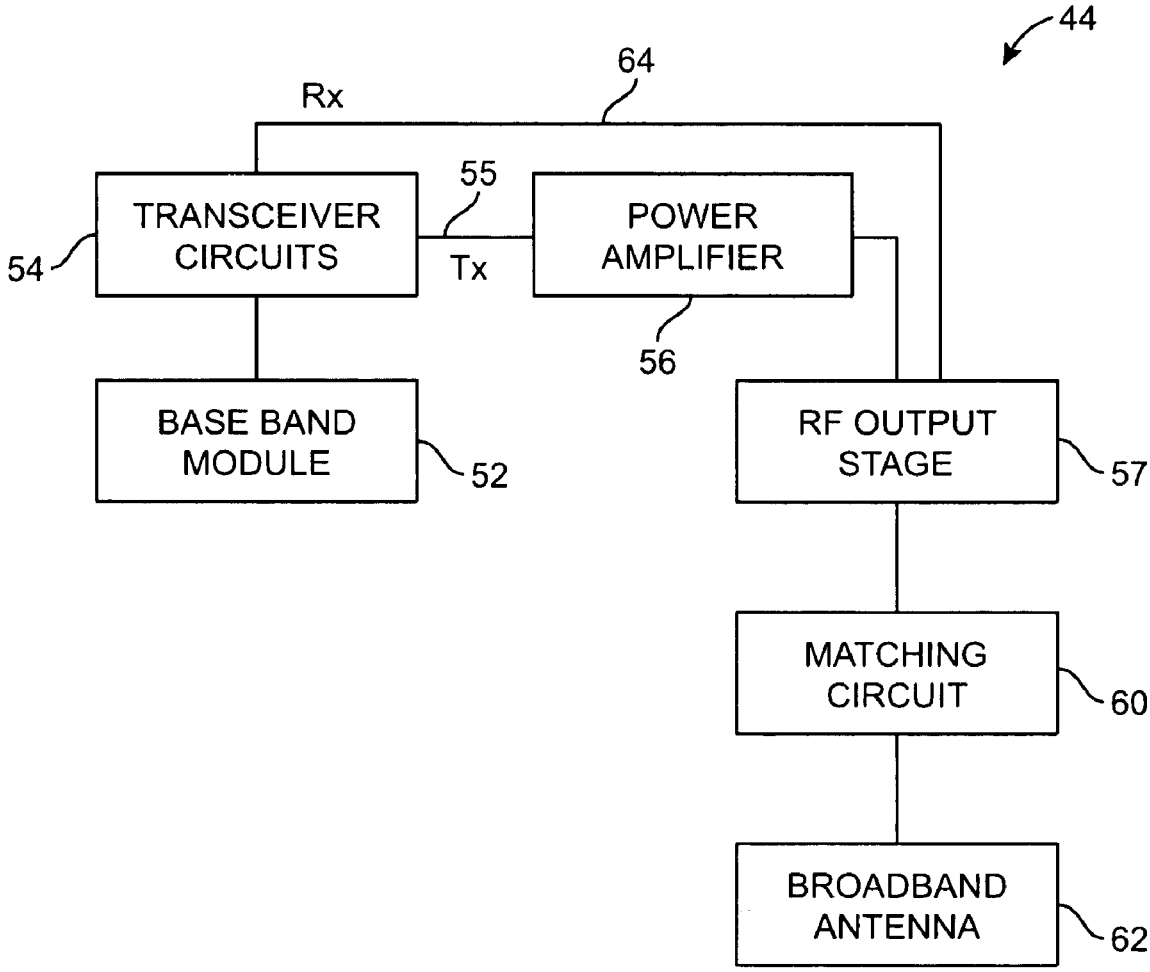
FIG. 3 is a schematic diagram of illustrative wireless circuitry for a handheld electronic device in accordance with the present invention.

Illustrative wireless communications devices 44 that are based on a broadband antenna arrangement are shown in FIG. 3. As shown in FIG. 3, wireless communications devices 44 include at least one broadband antenna 62. Data signals that are to be transmitted by device 10 may be provided to baseband module 52 (e.g., from processing circuitry 36 of FIG. 2). Baseband module 52 may provide data to be transmitted to transmitter circuitry within transceiver circuits 54. The transmitter circuitry may be coupled to power amplifier circuitry 56 via path 55.

During data transmission, power amplifier circuitry 56 may boost the output power of transmitted signals to a sufficiently high level to ensure adequate signal transmission. Radio-frequency (RF) output stage 57 may contain radio-frequency switches and passive elements such as duplexers and diplexers. The switches in the RF output stage 57 may, if desired, be used to switch devices 44 between a transmitting mode and a receiving mode. Duplexer and diplexer circuits and other passive components in RF output stage may be used to route input and output signals based on their frequency.

Matching circuit 60 may include a network of passive components such as resistors, inductors, and capacitors and ensures that broadband antenna 62 is impedance matched to the rest of the circuitry 44. Wireless signals that are received by antenna 62 are passed to receiver circuitry in transceiver circuitry 54 over a path such as path 64.

Figure 4:
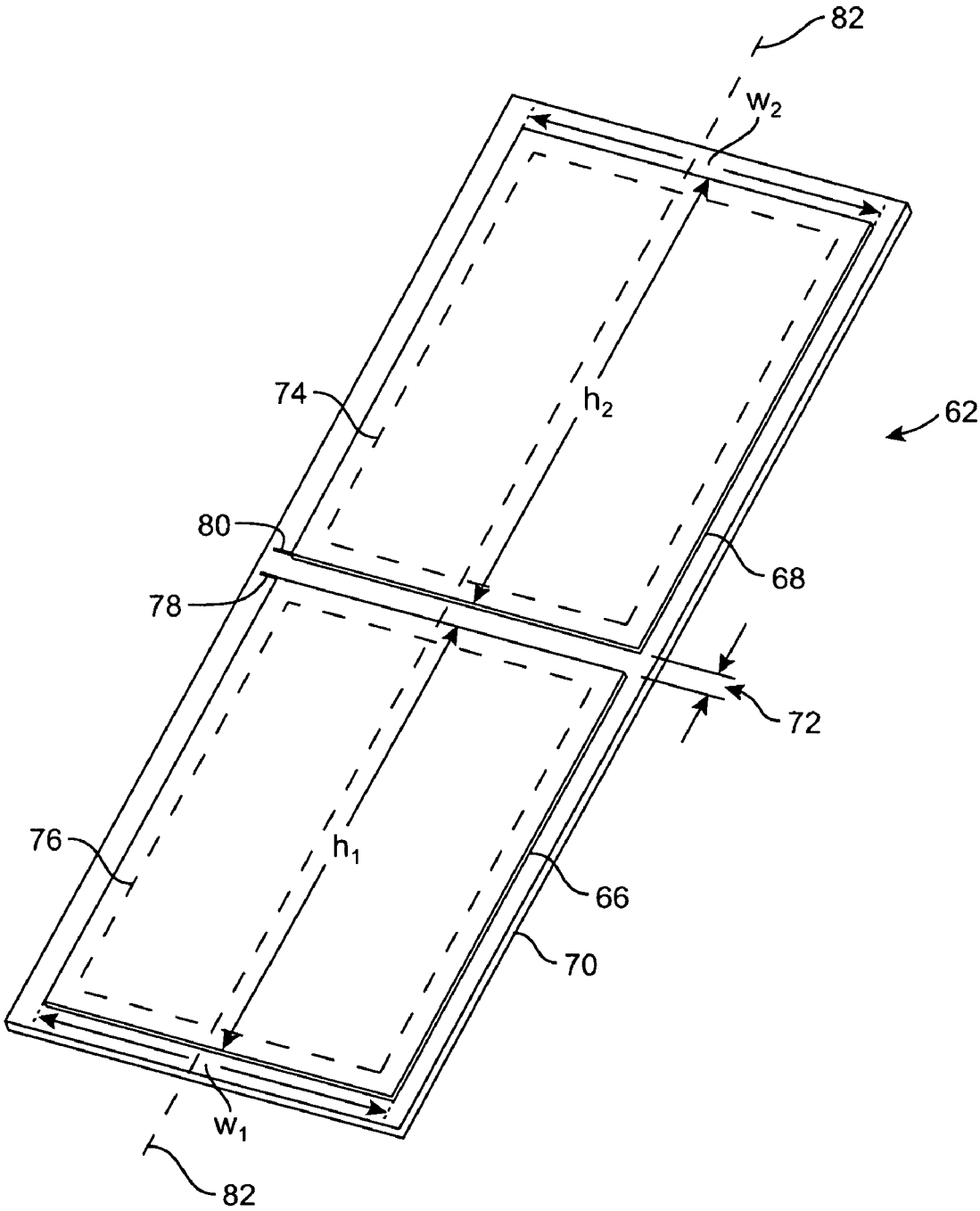
FIG. 4 is a perspective view of an illustrative broadband antenna in accordance with the present invention.

An illustrative arrangement that may be used for broadband antenna 62 is shown in FIG. 4. As shown in FIG. 4, antenna 62 may include a ground element 66 and a resonating element 68. The ground element 66 may have an associated ground terminal such as ground terminal 78. The ground element and ground terminal 78 are sometimes referred to (alone and collectively) as the ground of the antenna or the ground plane of the antenna. The ground terminal is also sometimes referred to as the negative terminal of the antenna. The resonating element 68 may have an associated terminal such as terminal 80. Terminal 80 is sometimes referred to as a positive antenna terminal or the antenna's feed terminal. Resonating element 68 and terminal 80 are also sometimes referred to (alone and collectively) as the feed of the antenna.

The ground element 66 and resonating element 68 may be formed on one or more mounting structures such as mounting structure 70. Mounting structure 70 may be any suitable mounting structure for proving physical support for elements 66 and 68. Suitable mounting structures include mounting structures formed from circuit board materials, ceramics, glass, plastic, or other dielectrics. The mounting structure 70 may, if desired, be formed from part of housing 12 (FIG. 1). For example, housing 12 may serve as mounting structure 70 or as part of mounting structure 70.

Suitable circuit board materials for mounting structure 70 include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Mounting structure 70 may be formed from a combination of any number of these materials or other suitable materials. Mounting structure 70 may be flexible or rigid or may have both flexible and rigid portions. These are merely illustrative examples. In general, antenna components such as resonating element 68 and ground element 66 may be supported using any suitable structure.

Ground element 66 and resonating element 68 may be mounted so that they lie in the same plane. The plane in which ground element 66 and resonating element 68 lie may be a plane that lies within or nearly within a plane that contains the surface of mounting structure 70. For example, as shown in the illustrative arrangement of FIG. 4, ground element 66 and resonating element 68 may lie on the surface of a planar mounting structure 70, so that a common plane contains the ground element, the resonating element, and the surface of mounting structure 70.

A gap 72 may be used to separate ground element 66 and resonating element 68. In general, the gap 72 may be any suitable size, provided that the radio-frequency bandwidth and frequency coverage goals for broadband antenna 62 are satisfied. With one illustrative arrangement, the ground element 66 and resonating element 68 have lateral dimensions on the orders of several centimeters and gap 72 is several millimeters (e.g., 2-4 mm). Gap 72 may be an air or dielectric gap. An advantage of this type of arrangement is that it allows ground element 66 and resonating element 68 to fit within a conveniently sized handheld electronic device while still being sufficiently large to operate properly without interference from internal electronic components in the handheld electron device. This type of arrangement is, however, merely illustrative. Any suitable gap size and lateral antenna element dimensions may be used if desired. This is, however, merely illustrative.

The thickness of ground element 66 and radiating element 68 is typically less than 0.5 mm. The thickness that is used depends on the type of technology used to manufacture elements 66 and 68. With one suitable arrangement, elements 66 and 68 are formed from adhesive-backed copper foil of less than 0.2 mm in thickness. If elements 66 and 68 are formed by printing or otherwise depositing conductive films on a printed circuit board using the types of operations normally used during semiconductor fabrication processes, elements 66 and 68 may be even thinner. In general, any suitable thicknesses may be used for ground element 66 and radiating element 68. If desired, ground element 66 and radiating element 68 may have different thicknesses.

To avoid electrical interference and ensure that antenna 62 functions optimally, components of handheld electronic device 10 that may significantly influence the radio-frequency behavior of antenna 62 may be located away from gap 72. By locating electronic components in device 10 so that they do not overlap gap 72, interference with proper antenna operation is avoided.

Consider, as an example, a typical handheld electronic device. A typical handheld electronic device may contain components such as integrated circuits and batteries. Integrated circuits are often electrically shielded with a conductor. Integrated circuits may, for example, be shielded within a conformal sheet of copper. Batteries are often manufactured with a conductive casing formed from aluminum or other metals. Other electronic components such as liquid-crystal displays (LCDs) may also contain large amounts of metal or other conductive structures.

To ensure that the operation of antenna 62 is not adversely affected by the presence of the metal or other conductive structures within these electronic components, the electronic components can be located within regions that do not overlap gap 72, such as the regions located within the boundaries shown by dotted lines 74 and 76. If electronic components remain within the limits imposed by dotted lines 74 and 76, the radio-frequency performance of the antenna 62 will not be adversely affected by metal or other conductors overlapping gap 72 and will not be adversely affected by metal or other conductors overlapping the edges of ground element 66 and resonating element 68.

The sizes and shapes of the ground element 66 and resonating element 68 affect the radio-frequency performance of broadband antenna 62. If desired, ground element 66 and/or resonating element 68 may be constructed so that their heights are larger than their widths. The heights of elements 66 and 68 are taken along the dimension that is parallel to longitudinal axis 82 of antenna 62 and handheld electronic device 10 (i.e., along the longer of the two lateral dimensions of a typical handheld electronic device when viewed from the front). With this type of arrangement, ground element 66 has height $h_1$ that is larger than width $w_1$. Similarly, height $h_2$ of resonating element 68 is greater than width $w_2$ of resonating element 68. Because the heights of elements 66 and 68 are greater than their widths, elements 66 an 68 have a greater-than-unity aspect ratio (h/w). The greater-than-unity aspect ratio of elements 66 and 68 tends to make the antenna 62 vertically polarized when device 10 is held vertically in a user's hand. Vertically-polarized handheld electronic device antenna arrangements can be advantageous for communicating with vertically-polarized base stations. The use of greater-than-unity aspect ratios for ground element 66 and resonating element 68 are merely illustrative. Any suitable aspect ratios may be used for ground element 66 and resonating element 68 if desired.

In the example of FIG. 4, elements 66 and 68 have the same size. In particular, heights $h_1$ and $h_2$ are equal, widths $w_1$ and $w_2$ are equal, and areas $A_1=h_1 \times w_1$ and $A_2=h_2 \times w_2$ of the antenna elements 66 and 68, respectively, are equal. Because areas $A_1$ and $A_2$ are the same, antenna 62 exhibits a wide and relatively flat bandwidth. If desired, the sizes of elements 66 and 68 may be made unequal. For example, the ratio of the antenna element areas may be in the range of between 0.95 and 1.05 (as an example), may be in the range of between 0.9 and 1.1 (as another example), may be in the range of between 0.8 and 1.2 (as yet another example), etc. Care should be taken, however, to avoid making the respective sizes of the ground element 66 and resonating element 68 too different. If, as an example, the area of the resonating element 68 (A2) is only 10% of the area of ground element 66 (A1), the antenna 62 may begin to behave as an asymmetric dipole. In this situation, the antenna's frequency response may exhibit "peaks" that cover certain bands (e.g., a lower band and an upper band), rather than exhibiting a desirable relatively flat and broad frequency characteristic.

Figure 5:
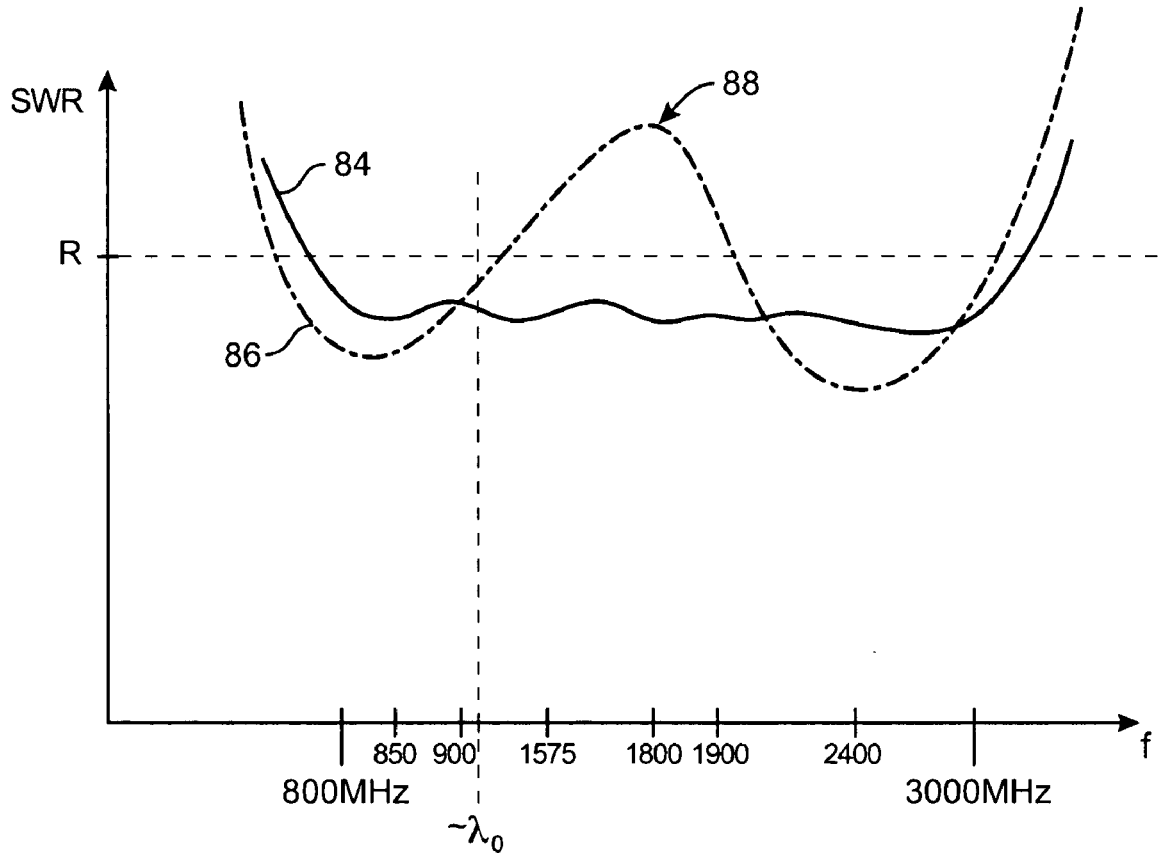
FIG. 5 is a graph showing illustrative performance characteristics for an illustrative broadband antenna in accordance with the present invention.

One way to characterize the performance of broadband antenna 62 involves the use of a standing-wave-ratio plot. The standing-wave ratio (SWR) of an antenna is a measure of the antenna's ability to efficiently transmit radio waves. Standing wave ratios R of less than about 3 are generally acceptable. A graph plotting an illustrative standing-wave-ratio versus frequency characteristic for an illustrative broadband antenna is shown in FIG. 5. In the example of FIG. 5, the ratio R is 3 or less. Solid line 84 shows the standing-wave ratio for illustrative antenna 62 versus frequency. The plot of FIG. 5 illustrates the type of frequency response that a broadband antenna of the general type shown in FIG. 4 can achieve. When implementing an antenna, the frequency range, the standing-wave-ratio flatness, and the maximum standing-wave-ratio (R in the plot of FIG. 5) that are achieved by the antenna depend on a variety of factors, such as antenna conductor material, antenna shape, antenna size, gap size, substrate material, electronic component placement, etc.

As shown in FIG. 5, antenna 62 can cover a frequency range of about 800 MHz to about 3000 MHz (as an example). In this frequency range, the SWR level of the antenna never rises above R (e.g., 3.0, 2.5, 2.0 or other suitable level). If the ratio of antenna element areas were to become too large (e.g., if ground element 66 were to be 10 times the size of resonating element 68), the antenna would behave as an asymmetric dipole and would have a frequency response characterized by dashed-dotted line 86. The antenna would therefore have a frequency range (e.g., a range about frequency 88), in which the SWR performance of the antenna is unacceptable (i.e., well above acceptable standing-wave ratio R). Elements 66 and 68 may be constructed with lateral dimensions on the order of $\lambda_0/2$, where an approximate location for a suitable value of $\lambda_0$ is shown on the frequency axis of the graph of FIG. 5.

Because antenna 62 exhibits a relatively flat frequency response from 800 MHz to 3000 MHz, antenna 62 is able to cover desirable communications frequency bands such as the cellular telephone bands at 850 MHz, 900 MHz, 1800 MHz, and 1900 MHz (e.g., the main Global System for Mobile Communications or GSM cellular telephone bands), the global positioning system (GPS) band at 1575 MHz, data service bands such as the 3G data communications band at 2170 MHz band (commonly referred to as UMTS or Universal Mobile Telecommunications System), the WiFi® (IEEE 802.11) band at 2.4 GHz, and the Bluetooth® band at 2.4 GHz. These bands and other suitable bands are examples of bands that can be covered by antenna 62 if desired. As additional bands of interest are added through deployment of future services, these bands may also be handled by antenna 62.

As described in connection with FIG. 4, it may be desirable to place integrated circuits and other electronic components of handheld electronic device in a position within handheld electronic device that avoids overlap with gap 72 and that avoids creating protrusions of the electronic components over the edges of ground element 66 and radiating element 68 (i.e., the edges adjacent to gap 72 and the non-gap edges of elements 66 and 68). A schematic plan view of an illustrative handheld device showing how electronic components may be placed so that they remain within the outer perimeter of the antenna elements is shown in FIG. 6.

Figure 6:
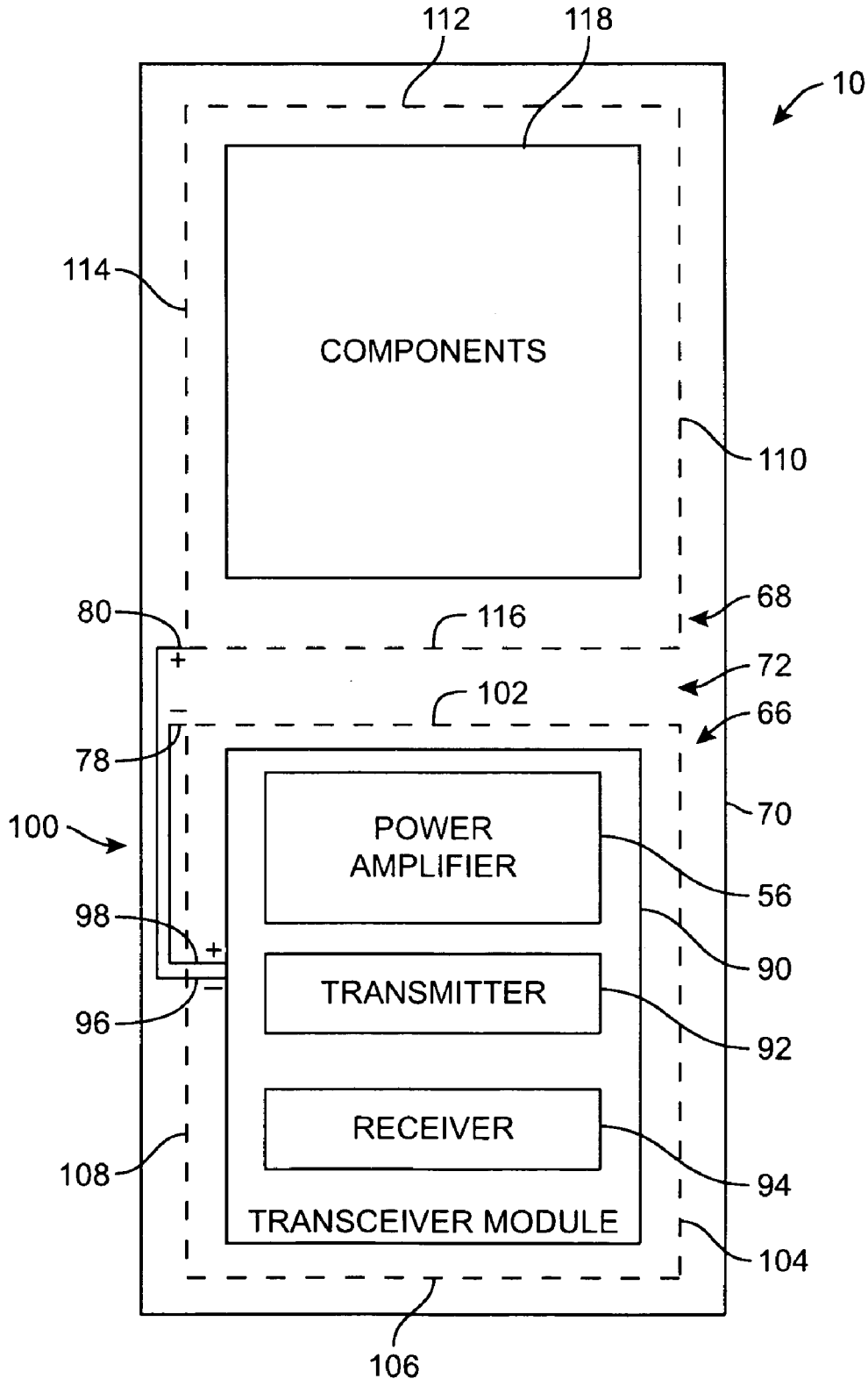
FIG. 6 is a diagram showing how an illustrative transceiver module may be electrically connected to an illustrative broadband antenna in a handheld electronic device in accordance with the present invention.

As shown in FIG. 6, handheld electronic device 10 has ground element 66 and radiating element 68, whose positions are represented by dotted lines. Electronic components 90 and 118 may include a transceiver module containing a power amplifier 56 and transceiver circuitry such as transceiver circuits 54 of FIG. 3 (e.g., receiver 94 and transmitter 92). The transceiver module may have a ground terminal 96 and a feed terminal 98, which are electrically connected to ground terminal 78 and feed terminal 80 of elements 66 and 68 via antenna signal path 100. Because electronic components 90 do not protrude over edges 104, 106, 108, or 110 of ground element 66, because electronic components 118 do not extend beyond edges 110, 112, 114, and 116 of resonating element 68, and because none of the electrical components are overlaid on top of the gap 72, the radio-frequency performance of the broadband antenna will not be adversely affected by the conductive materials in the electrical components.

Antenna signal path 100 may be formed using any suitable radio-frequency signal path arrangement. With one illustrative arrangement, path 100 may be formed from a length of coaxial cable. If desired, path 100 may be formed from layered structures of conductor and dielectric. These are merely illustrative arrangements for path 100. Any suitable path structure may be used for path 100 if desired.

Figure 7:
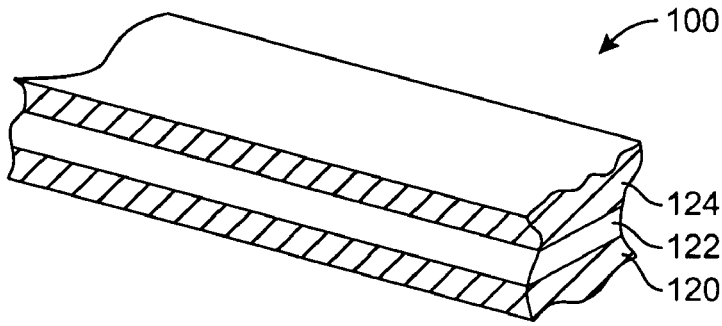
FIG. 7 is a perspective view of an illustrative conductive path based on thin films of conductor and dielectric that may be used to interconnect a transceiver with a broadband antenna in accordance with the present invention.

Illustrative structures that may be used for paths such as path 100 of FIG. 6 are shown in FIGS. 7-11. An illustrative microstrip path is shown in FIG. 7. Path 100 of FIG. 7 has a lower conductor 120, a dielectric 122, and an upper conductor 124. Path 100 of FIG. 7 may be formed as a freestanding path (e.g., using a flexible dielectric such as polyimide) or may be formed as part of another structure (e.g., mounting structure 70). Any suitable conductive materials may be used for upper and lower conductors 124 and 120. In general, high-conductivity materials are beneficial, because high-conductivity materials reduce antenna losses. Lower conductor 120 may be ground and may be connected between module terminal 96 and antenna terminal 78 in FIG. 6. Upper conductor 122 may be the antenna's feed and may be connected between module terminal 98 and antenna terminal 80. With one suitable arrangement, lower conductor 120 and upper conductor 124 are formed from a metal such as copper. Dielectric layer 122 may be formed from a flexible or rigid circuit board material (if desired). Suitable materials for dielectric layer 122 include paper impregnated with phonolic resin, resins reinforced with glass fibers such as fiberglass mat impregnated with epoxy resin (e.g., FR-4), plastics, polytetrafluoroethylene, polystyrene, polyimide, and ceramics.

Figure 8:
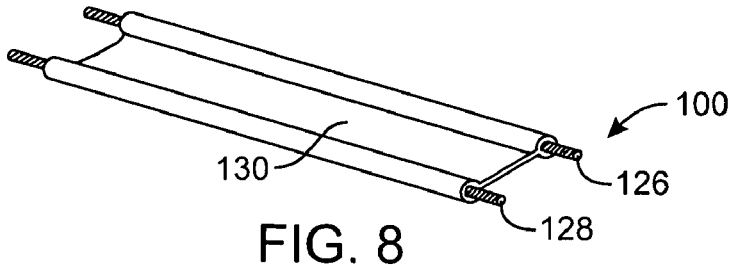
FIG. 8 is a perspective view of an illustrative twin lead conductive path that may be used to interconnect a transceiver with a broadband antenna in accordance with the present invention.

In the arrangement of FIG. 8, path 100 has two wire conductors 126 and 128 separated by a dielectric 130 (e.g., plastic). Conductors 126 and 138 may be, as an example, braided or solid copper. Paths of the type shown in FIG. 8 are sometimes referred to as twinlead paths.

Figure 9:
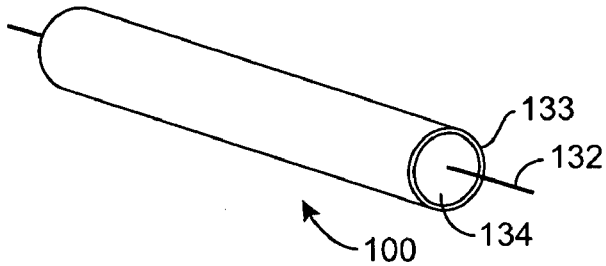
FIG. 9 is a perspective view of an illustrative coaxial cable that may be used to interconnect a transceiver with a broadband antenna in accordance with the present invention.

FIG. 9 shows how a coaxial cable can be used to form path 100. The cable has inner conductor 132, outer conductor 133, and dielectric 134. With one suitable arrangement, inner conductor 132 is formed from solid copper wire. Outer conductor 133 may be formed from braided copper filaments. Dielectric 134 may be formed from polyethylene or polytetrafluoroethylene (as an example).

Figure 10:
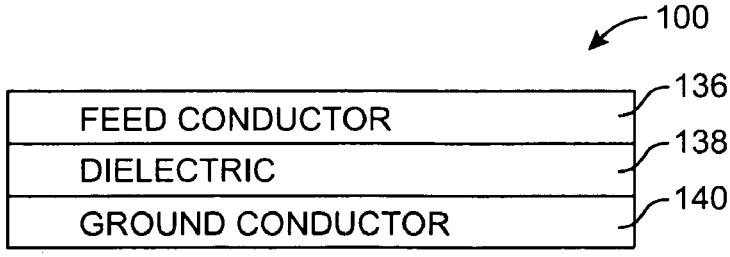
FIG. 10 is a cross-sectional view of an illustrative conductive path based on a microstrip configuration that may be used to interconnect a transceiver with a broadband antenna in accordance with the present invention.

A side view of an illustrative path of the general type shown in FIG. 7 is shown in FIG. 10. As shown in FIG. 10, ground conductor 140 and feed conductor 136 in path 100 may be separated by a dielectric 138. Ground 140 and feed 136 may be formed from copper or other suitable conductive materials. Dielectric 138 may be formed from polyimide (as an example).

Figure 11:
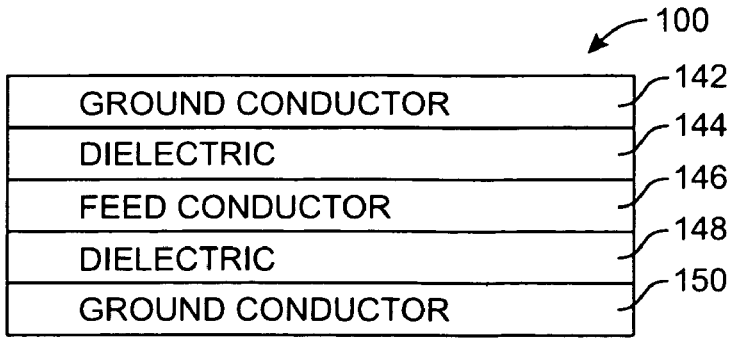
FIG. 11 is a cross-sectional view of an illustrative conductive path based on a stripline configuration that may be used to interconnect a transceiver with a broadband antenna in accordance with the present invention.

FIG. 11 shows a side view of an illustrative path in which the feed is sandwiched between two grounds. Path 100 of FIG. 11 has a central feed conductor 146. Feed conductor 146 may be separated from ground conductor 150 by dielectric 148. Feed conductor 146 may be separated from ground conductor 142 by dielectric 144. Ground conductors 142 and 150 may, as an example, be formed from copper or other highly conductive metals. Dielectric layers 144 and 148 may be formed from polyimide or other suitable insulators.

Figure 12:
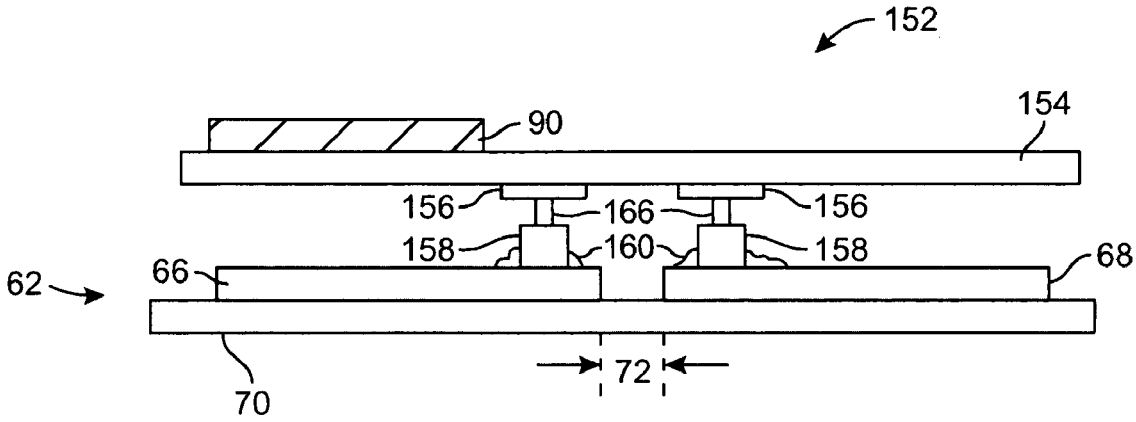
FIG. 12 is a cross-sectional side view of an illustrative broadband antenna connected to a circuit board on which integrated circuits have been mounted in accordance with the present invention.

A cross-sectional side view of a portion of an illustrative handheld electronic device containing a broadband antenna is shown in FIG. 12. Handheld electronic device portion 152 includes antenna 62 and a mounting structure 154 on which electrical components 90 are mounted. Electrical components 90 may be, for example, integrated circuits. Mounting structure 154 may be formed from any suitable material such as circuit board material. With one suitable arrangement, mounting structure 154 is formed from a rigid double-sided FR-4 circuit board.

Antenna 62 may include a mounting structure 70 formed from a circuit board, a support formed from circuit board materials, the housing of a handheld electronic device, or other suitable structures. Antenna ground element 66 and resonating element 68 may be formed on top of the upper surface of mounting structure 70. Conductive structures such as spring-loaded pins 158 may be used to make contact between the ground and feed terminals of antenna 62 and conductive paths (e.g., conductive traces) formed on board 154. With one suitable arrangement, circuit board pads 156 are formed on the lower surface of board 154. Tips 166 of spring-loaded pins 158 press against pads 156 and form a good ohmic contact. Solder 160 may be used to electrically and mechanically connect pins 158 to the ground and feed terminals of antenna 62. Vias in board 154 may be used to make electrical contact between traces on the lower surface of board 154 and the upper surface of board 154. Electronic components 90 may be electrically connected to the upper surface traces (e.g., using solder ball bonding or other suitable electrical interconnection arrangements).

Figure 13:
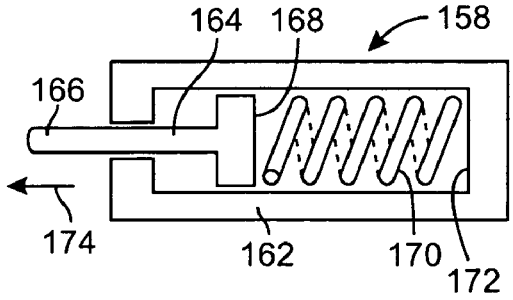
FIG. 13 is a cross-sectional side view of an illustrative spring-loaded pin that may be used to make electrical connections between a broadband antenna and circuit board in an arrangement of the type shown in FIG. 12 in accordance with the present invention.

A cross-section of an illustrative spring-loaded pin is shown in FIG. 13. Pin 158 contains a spring 170 and reciprocating plunger 164. Spring 170 is compressed between inner surface 172 of pin housing 162 and surface 168 of reciprocating plunger 164. In operation, the compressed spring biases plunger 164 in direction 174, so that tip 166 is driven against pads 156 (FIG. 12).

The ground element and resonating element of antenna 62 need not be rectangular in shape. For example, the ground element and resonating element may be squares, trapezoids, ovals, shapes with curves, or 5-sided, 6-sided, or n-sided polygons, where n is any suitable integer.

Figure 14:
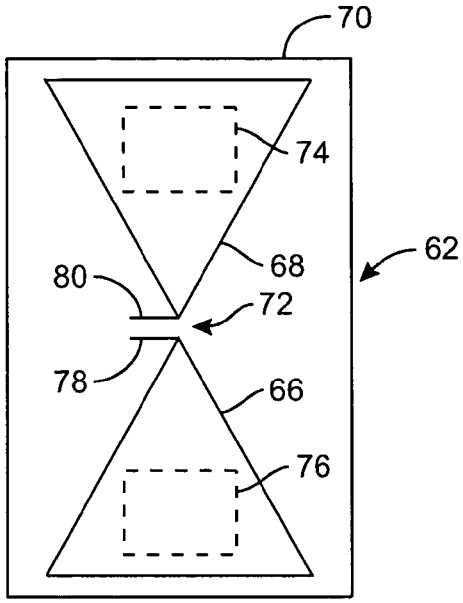
FIG. 14 is a plan view of an illustrative broadband antenna having triangular antenna elements in accordance with the present invention.
Figure 15:
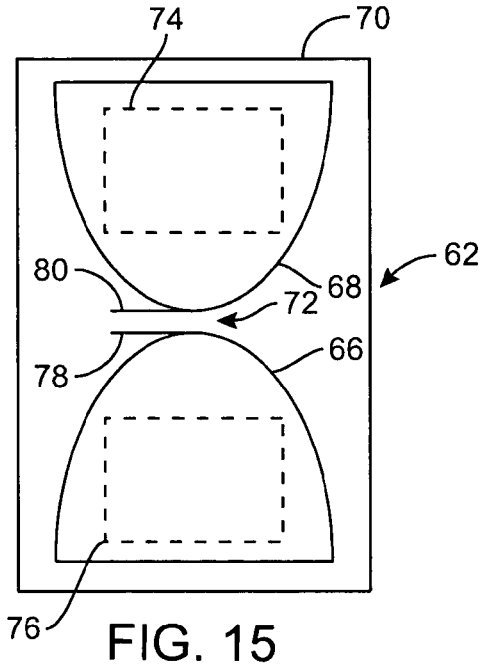
FIG. 15 is a plan view of an illustrative broadband antenna having rounded antenna elements in accordance with the present invention.
Figure 16:
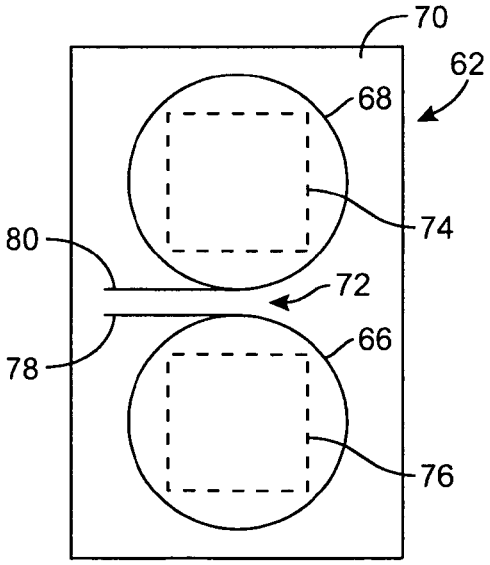
FIG. 16 is a plan view of an illustrative broadband antenna having circular antenna elements in accordance with the present invention.
Figure 17:
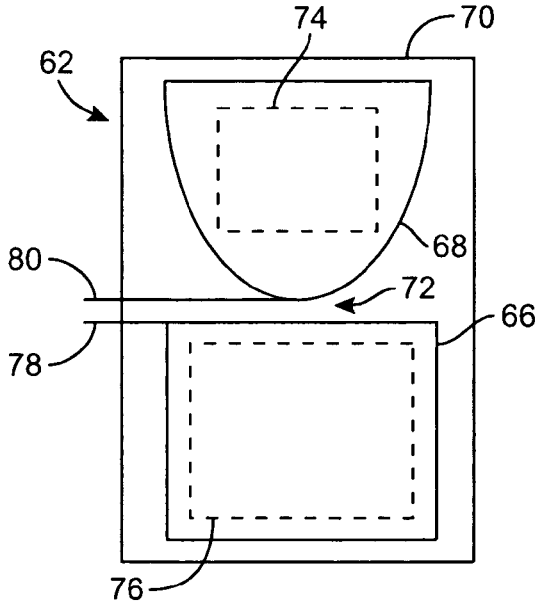
FIG. 17 is a plan view of an illustrative broadband antenna having elements of different shapes in accordance with the present invention.
Figure 18:
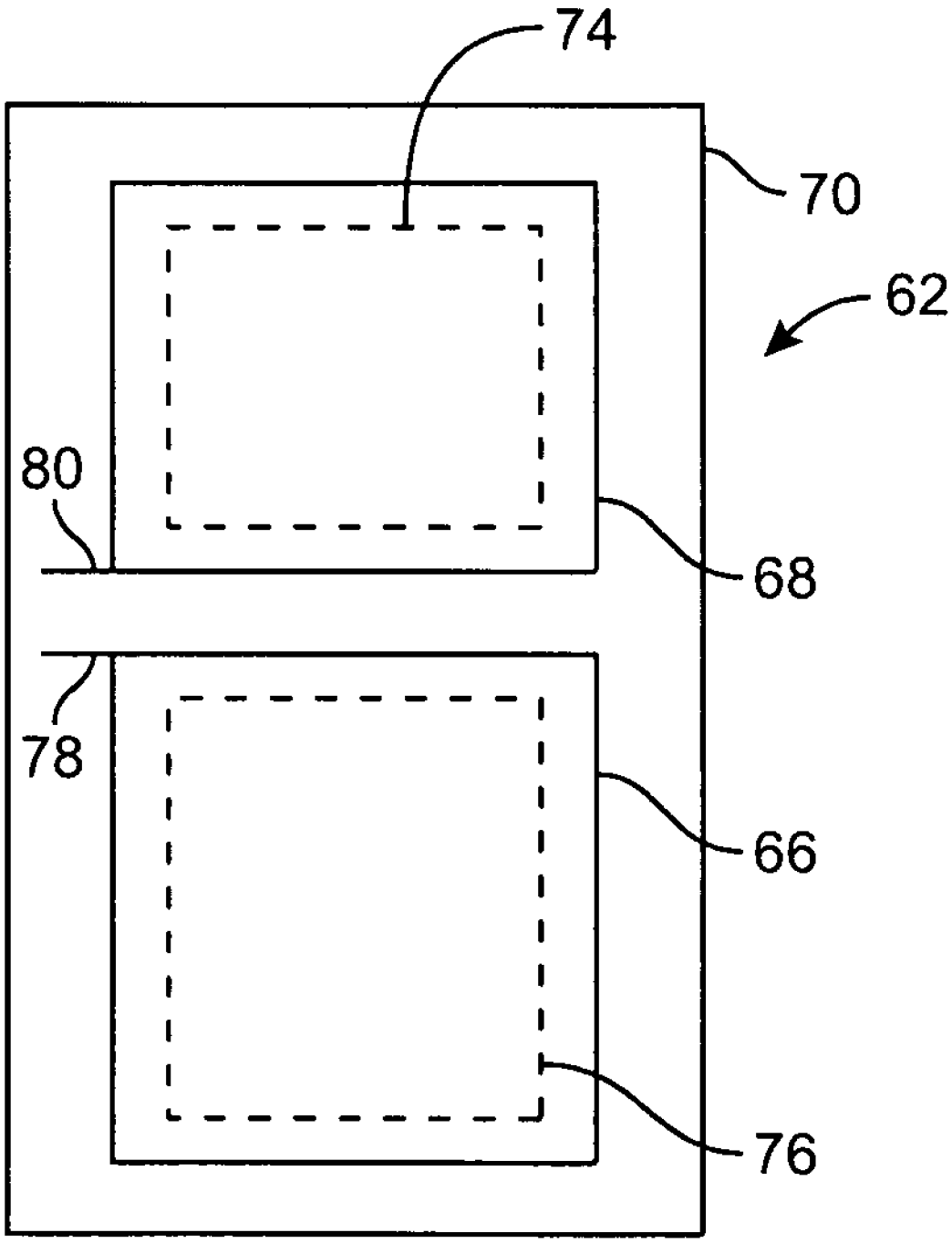
FIG. 18 is a plan view of an illustrative broadband antenna having rectangular elements of somewhat different sizes in accordance with the present invention.

An example where ground element 66 and resonating element 68 are triangular in shape is shown in FIG. 14. To avoid interference with the radio-frequency performance of antenna 62, electronic components in device 10 can be placed so that they lie within the boundary of regions 76 and 74 (or within even larger regions within the confines of the edges of elements 66 and 68). As shown in FIG. 15, ground element 66 and resonating element 68 may be formed using antenna shapes that have curves. The arrangement of FIG. 16 uses circular ground element 66 and circular resonating element 68. FIG. 17 shows how the shapes of the ground element and resonating element need not be the same. The FIG. 17 example has square ground element 66 and curved half-oval resonating element 68. FIG. 18 shows a configuration for antenna 62 in which ground element 66 and resonating element 68 are formed from rectangles of unequal size. This type of arrangement causes the antenna to behave as an asymmetric dipole and, if the sizes are too unequal, can lead to undesirable frequency responses of the type shown by curve 86 in FIG. 5. Nevertheless, slightly unequal sizes may be acceptable and in some circumstances may be advantageous in that they produce larger areas 76 in which electronic components may be located.

Figure 19:
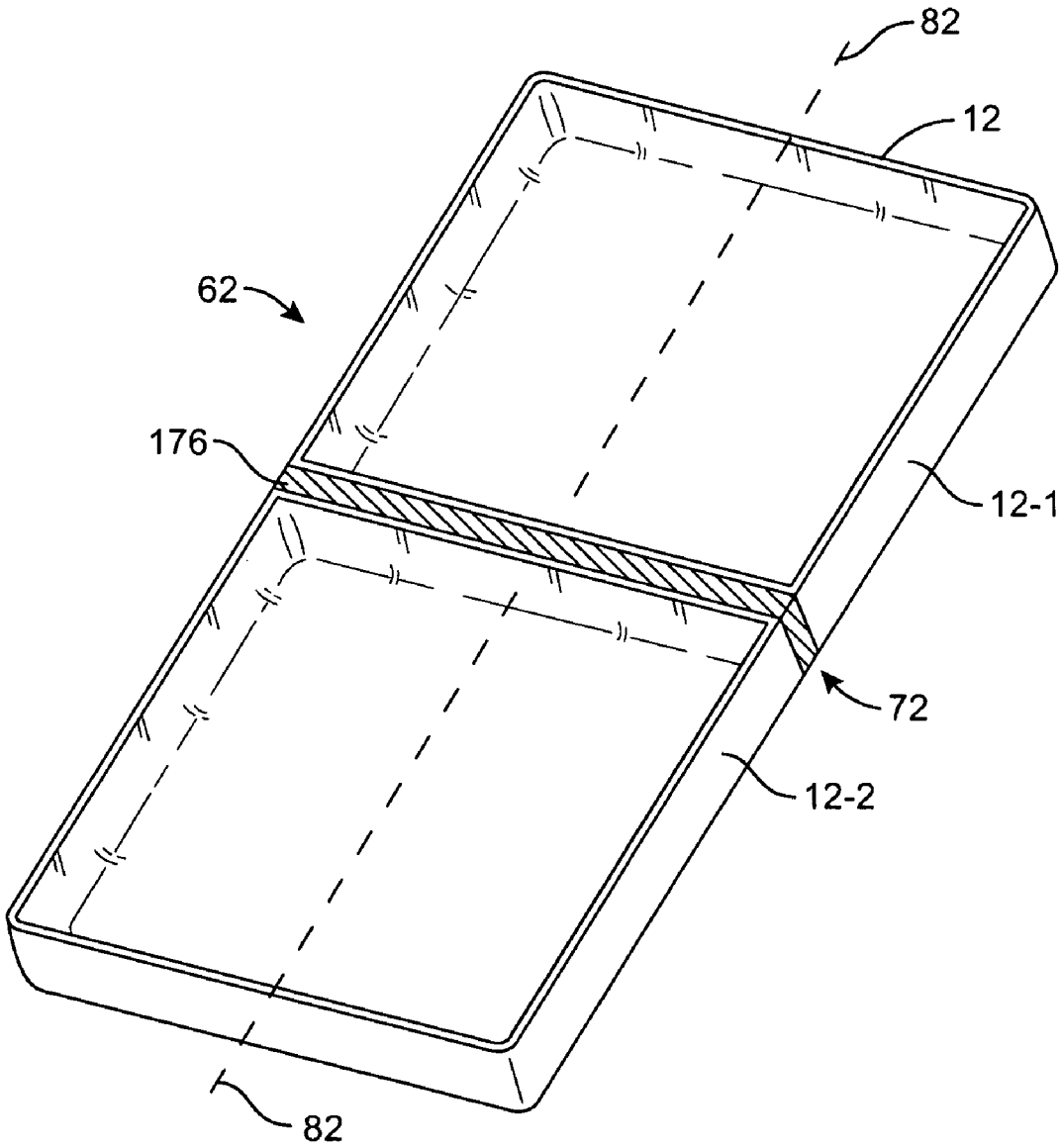
FIG. 19 is a perspective view of an illustrative broadband antenna formed from portions of a metal case in accordance with the present invention.

If desired, the ground element and resonating element may be formed using portions of housing 12 (also referred to as case 12). This type of configuration is shown in FIG. 19. As shown in FIG. 19, housing 12 has been electrically divided into upper housing portion 12-1 and lower housing portion 12-2. Housing portions 12-1 and 12-2 may be co-planar as shown in FIG. 19 (i.e., housing portion 12-1 and housing portion 12-2 may lie in a common plane that is parallel to the plane of the front face 22 of FIG. 1 of handheld electronic device 10). Housing portions 12-1 and 12-2 may, as shown in FIG. 19, form the rear face of the handheld electronic device. If desired, the housing portions 12-1 and 12-2 may be substantially the same size and/or substantially the same shape.

Housing 12 of FIG. 19 may be formed of a conducive material. With one suitable arrangement, housing 12 is formed from a metal such as aluminum or stainless steel. The housing may be coated with a thin layer of insulator to avoid interference from human contact. For example, an aluminum case may be anodized to form an insulating layer (e.g., an insulating layer that contains aluminum oxide).

Housing portion 12-2 forms ground element 66 of antenna 62 and housing portion 12-1 forms resonating element 68. Housing portion 12-1 and housing portion 12-2 are separated by gap 72 (in the example of FIG. 19). Gap 72 may be filled with a dielectric such as plastic, epoxy, or other suitable non-conductive materials. The use of a strong dielectric helps to form a strong housing 12. If desired, additional support structures (e.g., strengthening members disposed along longitudinal axis 82) may be used to ensure that housing 12 and handheld electronic device 10 have satisfactory structural integrity.

Figure 20:
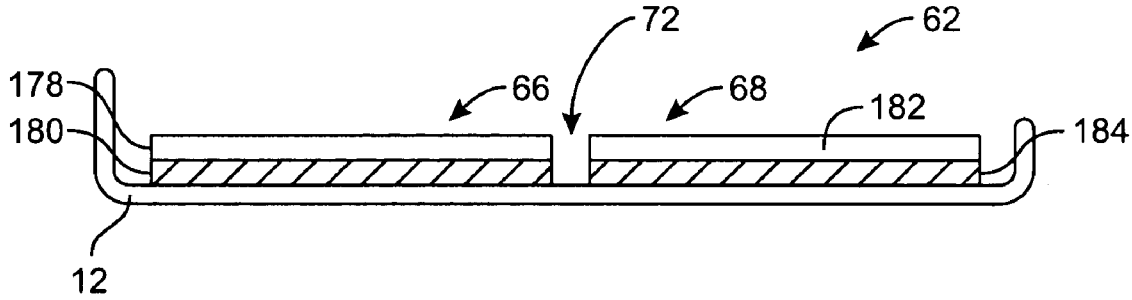
FIG. 20 is a cross-sectional view of an illustrative broadband antenna mounted to a case of a handheld electronic device in accordance with the present invention.

A cross-sectional side view of another illustrative antenna structure is shown in FIG. 20. In the arrangement shown in FIG. 20, antenna 62 has been formed from adhesive-backed foil elements. Ground element 66 is formed from metal foil 178 and resonating element 68 is formed from metal foil 182. Metal foil portions 178 and 182 may be, for example, copper foil. Copper foil portions 178 and 182 may be backed with adhesive 180 and 184 to attach foil portions 178 and 180 to case 12.

Figure 21:
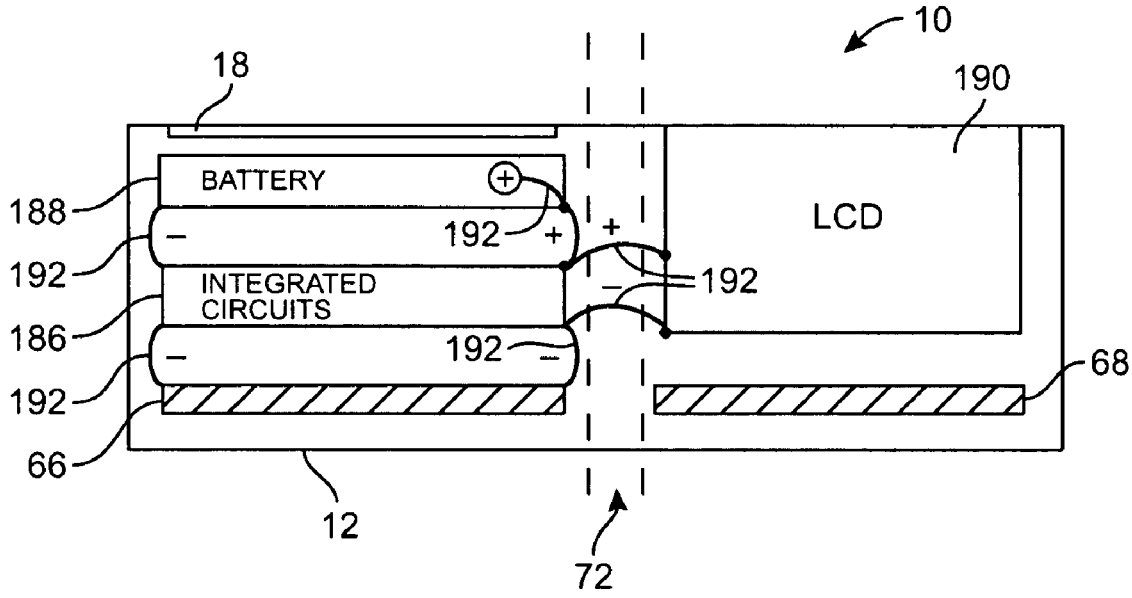
FIG. 21 is a cross-sectional side view of an illustrative broadband antenna in a handheld electronic device in accordance with the present invention.

FIG. 21 shows a cross-sectional side view of an illustrative handheld electronic device that contains a variety of electronic components. As described in connection with FIG. 4, it may be desirable to ensure that the electronic components do not extend substantially beyond the edges of ground element 66 and resonating element 68. With this approach, the electronic components may be maintained substantially within the boundaries established by the edges of ground element 66 and resonating element 68. It may also be desirable to ensure that the electronic components do not overlap gap 72. By ensuring that no metal surfaces encroach on gap 72, optimum antenna performance can be maintained. Wires 192 may be used to electrically connect the electronic components of FIG. 21 together.

In the illustrative arrangement of FIG. 21, user input interface 18 (e.g., user controls such as buttons), battery 188 (which may include one or more battery cells), and integrated circuits 186 are shown as being aligned with ground element 66. User input interface 18 may not contain substantial amounts of metal and may be spaced relatively far from the gap between element 66 and 68, so, if desired, user input interface 18 may overlap with gap 72 somewhat and may extend laterally over the edges of element 66. Battery 188 typically has a metal casing and integrated circuits 186 typically have metal RF shielding, so with one suitable arrangement, battery 188 and integrated circuits 186 do not overlap gap 72, as shown in FIG. 21. In the illustrative layout of FIG. 21, LCD 190 is located above resonating element 68. LCD 190 may contain large conductive surfaces (e.g., planar ground conductors), so LCD 190 may be located above resonating element 68 without protruding into gap 72.

Figure 22:
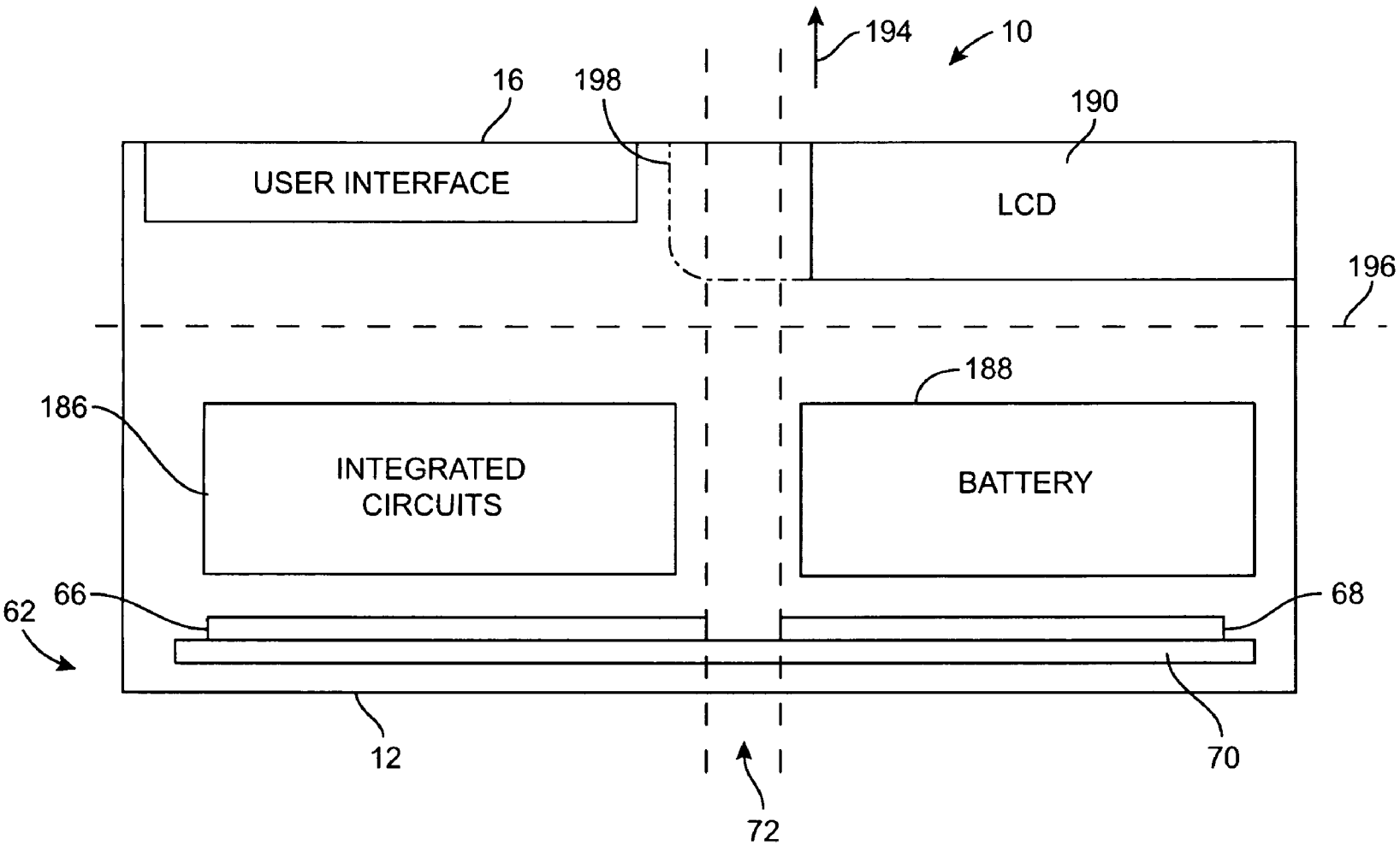
FIG. 22 is a cross-sectional side view of another illustrative broadband antenna in a handheld device in accordance with the present invention.

A cross-sectional side view of another illustrative handheld electronic device containing a variety of electronic components is shown in FIG. 22. In the example of FIG. 22, user control interface 16 has been formed on the upper surface of device 10. Integrated circuits 186 may be mounted in device 10 so that the edges of integrated circuits 186 do not extend beyond the edges of ground element 66. This prevents conductive surfaces such as copper shielding surrounding integrated circuits 186 from protruding into gap 72. As with the illustrative arrangement of FIG. 21, liquid crystal display 190 is located above resonating element 68. In vertical dimension 194, LCD 190 is relatively far from antenna 62 (e.g., LCD 190 is above a plane represented by dotted line 196). As a result, the conductive portions of LCD 190 may not have as great an impact on antenna performance as electronic components that are located closer to antenna 62 (e.g., components that are located below line 196). Because LCD 190 is located farther away from antenna 62 than other components, LCD 190 may, if desired, overlap somewhat with gap 72. An optional location for LCD 190 is indicated by dashed-dotted line 198. In general, however, interference can be minimized by ensuring that LCD 190 does not protrude into gap 72.

As shown in the arrangement of FIG. 22, battery 198 (which may include one or more individual battery cells), may be located so that it lies above resonating element 68 without extending beyond the edges of resonating element 68. An advantage of placing battery 188 in the location shown in FIG. 22 rather than the location shown in FIG. 21 is that the FIG. 22 arrangement may allow device 10 to be formed from a thinner case. In the arrangement of FIG. 21, battery 188 is stacked on top of integrated circuits 186, so there may be more thickness in the vicinity of ground element 66 than with the arrangement of FIG. 22 (in which only integrated circuits 186 are located above ground element 66).

Figure 23:
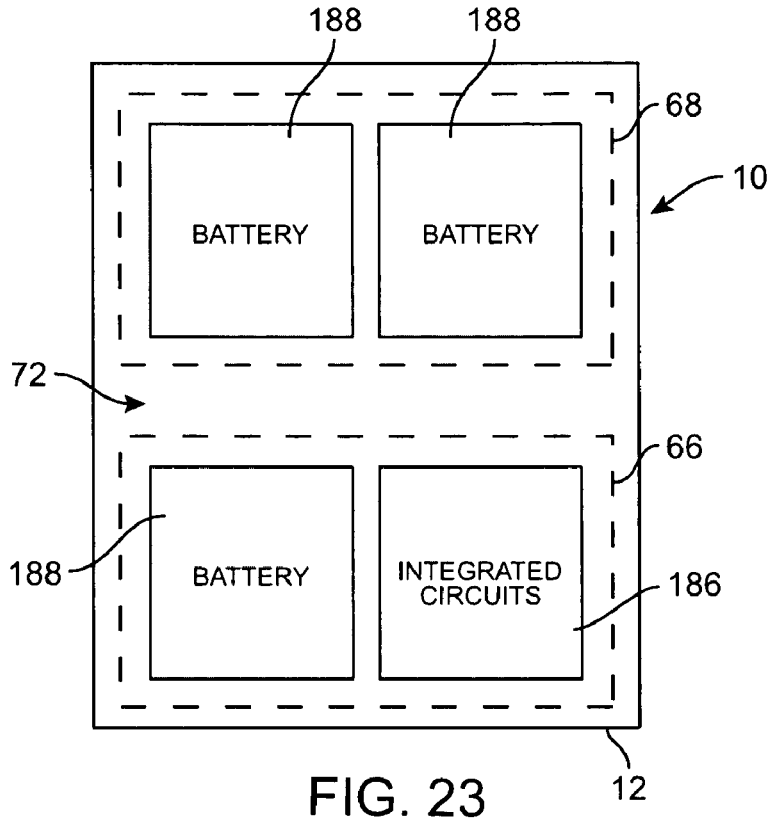
FIG. 23 is a plan view of an illustrative layout that may be used when locating handheld electronic device components relative to elements in a broadband antenna in accordance with the present invention.

FIG. 23 shows a plan view of an illustrative arrangement for handheld electronic device 10 in which two portions of battery 188 are located above resonating element 68, while one portion of battery 188 and integrated circuits 186 are located above ground antenna element 66. Gap 72 is not covered, so the performance of antenna 62 is not disturbed by the presence of electronic components containing conductive elements (e.g., metal shielding, planar ground structures, etc.).

Figure 24:
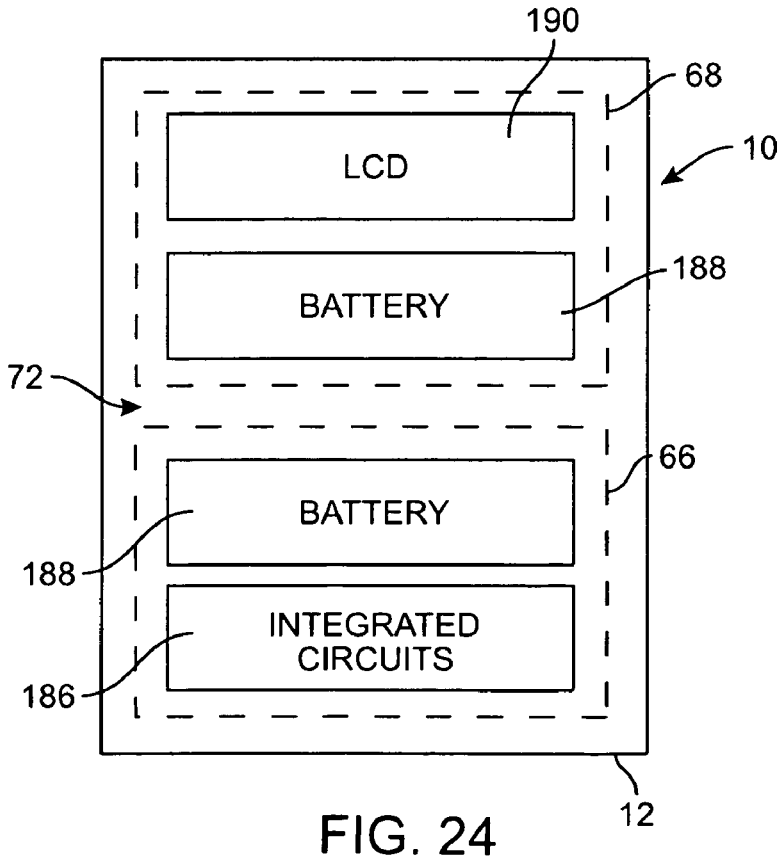
FIG. 24 is a plan view of another illustrative layout that may be used when locating handheld electronic device components relative to elements in a broadband antenna in accordance with the present invention.

Another possible approach is shown in FIG. 24. In FIG. 24, LCD 190 and a first portion of battery 188 are located above resonating antenna element 68, whereas a second portion of battery 188 and integrated circuits 186 are located above ground element 66. None of the components in FIG. 24 overlap gap 72 between ground element 66 and resonating element 68.

In general, any suitable components of handheld electronic device 10 can be located above ground elements 66 and 68. Components may be located so as to permit handheld electronic device 10 to be manufactured to desired dimensions. For example, if it is desired to manufacture a handheld electronic device that is very thin, electronic components can be relatively evenly distributed by using an arrangement of the type shown in FIG. 22. If there is a desire for a slightly larger area in which to locate integrated circuits, the area of ground element 66 can be expanded somewhat (e.g., 10%) at the expense of resonating element 68. Care should be taken, however, to maintain the flat frequency response of antenna 62, as described in connection with FIG. 5. Still other layouts may be used when it is desired to accommodate a particular component (e.g., an LCD screen or a battery of a particular size or shape).

The foregoing is merely illustrative of the principles of this invention and various modifications can be made by those skilled in the art without departing from the scope and spirit of the invention.

What is claimed is:

1. An electronic device comprising:

a non-folding housing having a planar inner surface, wherein the non-folding housing has a height that is measured along a first axis, a width that is measured along a second axis, and a thickness that is measured along a third axis, wherein the third axis is perpendicular to both the first axis and the second axis, and wherein the thickness of the non-folding housing is less than the width and the height of the non-folding housing;

a display mounted in the non-folding housing;

at least one integrated circuit mounted in the non-folding housing that provides data for the display, that generates data for wireless transmission, and that processes data that is wirelessly received by the electronic device; and wireless communications circuitry mounted in the non-folding housing that communicates with the integrated circuit, wherein the wireless communications circuitry comprises an antenna comprising a ground element and a resonating element that lie in a first plane that is parallel to the planar inner surface, wherein the first plane is parallel to both the first axis and the second axis, wherein the ground element and the resonating element have a common shape and a common size and are separated by a gap lying in the first plane, wherein the antenna has a height that is substantially equal to the height of the non-folding housing and has a width that is substantially equal to the width of the non-folding housing, wherein the display lies in a second plane that is substantially parallel to the first plane, wherein the display has portions that are separated from the resonating element along a first line that is parallel to the third axis, and wherein the display has portions that are separated from the ground element along a second line that is parallel to the third axis, such that the display overlaps the gap.

2. The electronic device defined in claim 1, wherein the ground element comprises a conductor with at least one curved edge.

3. The electronic device defined in claim 1 wherein the ground element comprises a triangular conductor.

4. The electronic device defined in claim 1 wherein the integrated circuit lies above the ground conductor and does not overlap the gap.

5. The electronic device defined in claim 1 wherein the integrated circuit lies above the ground conductor and does not overlap the gap, the electronic device further comprising a battery, wherein the battery lies above the resonating element and does not overlap the gap.

6. A handheld electronic device comprising:

a broadband antenna comprising a ground element and a resonating element, wherein the ground element and the resonating element have shapes that are substantially equal, lie in a first plane, and are separated by a gap in the first plane;

a battery;

a display that has edges;

a housing having a height, a width, and a thickness, wherein the thickness of the housing is less than the width and the height of the housing; and at least one integrated circuit, wherein the ground element has edges, wherein the resonating element has edges, and wherein the display is located in a second plane in the handheld electronic device, wherein the second plane is parallel to the first plane and is distinct from the first plane, wherein the edges of the display overlap the edges of the resonating element, wherein the edges of the display overlap the gap, and wherein the broadband antenna has a height that is substantially equal to the height of the housing and has a width that is substantially equal to the width of the housing.

7. The handheld electronic device defined in claim 6 wherein the integrated circuit has edges and wherein the integrated circuit is located in the handheld electronic device above the ground element such that the edges of the integrated circuit do not overlap the edges of the ground element and do not overlap the gap.

8. The handheld electronic device defined in claim 6 wherein the ground element comprises a ground terminal and wherein the resonating element comprises a feed terminal, the handheld electronic device further comprising an antenna signal path between the integrated circuit and the ground and feed terminals, wherein the antenna signal path comprises at least one ground conductor layer and at least one feed conductor layer separated by at least one dielectric layer.

9. The handheld electronic device defined in claim 6 wherein the ground element comprises a ground terminal and wherein the resonating element comprises a feed terminal, the handheld electronic device further comprising an antenna signal path between the integrated circuit and the ground and feed terminals, wherein the antenna signal path comprises a coaxial cable.

10. The handheld electronic device defined in claim 6 wherein the integrated circuit has edges, wherein the integrated circuit is located in the handheld electronic device above the ground element such that the edges of the integrated circuit do not overlap the edges of the ground element and do not overlap the gap, wherein the battery has edges, and wherein the battery is located in the handheld electronic device above the resonating element such that the edges of the battery do not overlap the edges of the resonating element and do not overlap the gap.

11. A handheld electronic device comprising:

a housing having a rectangular planar inner surface, wherein the housing has a height, a width, and a thickness, wherein the thickness of the housing is less than the width and the height of the housing;

a display that has edges and that is mounted in the housing;

an integrated circuit; and an antenna comprising a ground element and a resonating element, wherein the ground element and the resonating element have substantially equal sizes, lie in a first plane within the rectangular planar inner surface that is parallel to the rectangular planar inner surface, and are separated by a gap that lies in the first plane, wherein the ground element and the resonating element are formed from foil, wherein the antenna has a height that is substantially equal to the height of the housing and has a width that is substantially equal to the width of the housing, wherein the display is located in a second plane in the handheld electronic device, wherein the second plane is parallel to the first plane and is distinct from the first plane, and wherein the edges of the display overlap the gap.

12. The handheld electronic device defined in claim 11 further comprising:

a mounting structure formed from printed circuit board material, wherein the ground element and the resonating element are formed on the mounting structure.

13. The handheld electronic device defined in claim 11 wherein the housing is formed from dielectric and wherein the ground element and the resonating element are formed from adhesive-backed metal foil that is attached to the rectangular planar inner surface of the housing.

14. The handheld electronic device defined in claim 11 wherein the ground element and the resonating element have a common shape, wherein the integrated circuit has edges and wherein the integrated circuit is located in the handheld electronic device above the ground element such that the edges of the integrated circuit do not overlap the gap.

15. The handheld electronic device defined in claim 11 wherein the antenna exhibits a standing-wave-ratio of less than three from about 800 MHz to about 3000 MHz and wherein the ground element and resonating element comprise metal foil.

16. The handheld electronic device defined in claim 11 wherein the integrated circuit generates data that is transmitted through the antenna over at least five communications bands in a frequency range extending from 800 MHz to 3000 MHz, wherein the ground element is a metal foil rectangle, and wherein the resonating element is a metal foil rectangle.

* * * * *

UNITED STATES PATENT AND TRADEMARK OFFICE

CERTIFICATE OF CORRECTION

PATENT NO. : 7,764,236 B2
APPLICATION NO. : 11/650072
DATED : July 27, 2010
INVENTOR(S) : Robert J. Hill et al.

It is certified that error appears in the above-identified patent and that said Letters Patent is hereby corrected as shown below:

In column 8, line 48, delete “an” and insert -- and --, therefor.

Signed and Sealed this
Eighth Day of November, 2011

David J. Kappos

David J. Kappos
*Director of the United States Patent and Trademark Office*